US009385429B2

(12) United States Patent
Zhang

(10) Patent No.: US 9,385,429 B2
(45) Date of Patent: Jul. 5, 2016

(54) PENTA-BAND INTERNAL ANTENNA AND MOBILE COMMUNICATION TERMINAL THEREOF

(75) Inventor: Lian Zhang, Guangdong (CN)

(73) Assignee: HUIZHOU TCL MOBILE COMMUNICATION CO., LTD., Huizhou, Guangdong (CN)

( * ) Notice: Subject to any disclaimer, the term of this patent is extended or adjusted under 35 U.S.C. 154(b) by 368 days.

(21) Appl. No.: 13/816,217

(22) PCT Filed: Nov. 5, 2011

(86) PCT No.: PCT/CN2011/081835

§ 371 (c)(1),
(2), (4) Date: Feb. 8, 2013

(87) PCT Pub. No.: WO2012/071967

PCT Pub. Date: Jun. 7, 2012

(65) Prior Publication Data

US 2013/0141298 A1 Jun. 6, 2013

(30) Foreign Application Priority Data

Dec. 1, 2010 (CN) ..... 2010 1 0568427

(51) Int. Cl.
*H01Q 1/24* (2006.01)
*H01Q 9/04* (2006.01)
(Continued)

(52) U.S. Cl.
CPC ..... *H01Q 9/0414* (2013.01); *H01Q 1/243* (2013.01); *H01Q 1/245* (2013.01); *H01Q 1/48* (2013.01); *H01Q 5/364* (2015.01); *H01Q 5/385* (2015.01); *H01Q 9/0421* (2013.01)

(58) Field of Classification Search
CPC ..... H01Q 1/243; H01Q 1/245; H01Q 9/0414; H01Q 5/0065; H01Q 9/0421; H01Q 5/0055; H01Q 5/364; H01Q 5/385
USPC ..... 343/700 MS, 702, 725, 767, 770
See application file for complete search history.

(56) References Cited

U.S. PATENT DOCUMENTS 4,800,392 A * 1/1989 Garay ..... H01Q 1/243 343/700 MS
4,968,984 A * 11/1990 Katoh ..... H01Q 1/32 343/713

(Continued)

FOREIGN PATENT DOCUMENTS

CN 1357163 A 7/2002
CN 1495966 A 5/2004

(Continued)

OTHER PUBLICATIONS

Kin-Lu Wang, Yun-Wen Chi, and Shu Yang Tu, Internal multiband printed folded slot antena for mobile phone application, Microwave and Optical Technology Letters., Aug. 31, 2007, p. 1833-37, vol. 49, issue 8.

(Continued)

*Primary Examiner* — Michael C Wimer
(74) *Attorney, Agent, or Firm* — Shimokaji IP

(57) ABSTRACT

A penta-band internal antenna and a mobile communication terminal may include: a first high-frequency branch, a second high-frequency branch, and a low-frequency branch of an antenna radiating element, and a first slotted hole and a second slotted hole arranged on a printed circuit board. The first slotted hole may be arranged along a direction substantially perpendicular to the current flow direction of the printed circuit board. The open-circuit end of the low-frequency branch may be fitted into the first slotted hole and the open-circuit end of the second high-frequency branch may be fitted into the second slotted hole.

20 Claims, 3 Drawing Sheets

(51) Int. Cl.

| | |
|---|---|
| ***H01Q 1/48*** | (2006.01) |
| ***H01Q 5/364*** | (2015.01) |
| ***H01Q 5/385*** | (2015.01) |

(56) References Cited

U.S. PATENT DOCUMENTS 5,365,242 A * 11/1994 Shiina ..... H01Q 9/44 343/713
6,252,552 B1 * 6/2001 Tarvas et al. ..... 343/700 MS
7,443,344 B2 * 10/2008 Boyle ..... 343/700 MS
8,587,491 B2 * 11/2013 Badaruzzaman et al. .... 343/767
2006/0145924 A1 7/2006 Chen et al.

FOREIGN PATENT DOCUMENTS

WO 2006070017 A1 7/2006
WO 2006114477 A1 11/2006

OTHER PUBLICATIONS

Chinese Office Action in CN Application No. 201010568427.3 dated Feb. 17, 2013.

* cited by examiner

PENTA-BAND INTERNAL ANTENNA AND MOBILE COMMUNICATION TERMINAL THEREOF

TECHNICAL FIELD

The present invention relates to the field of broadband antennas of wireless communication devices and, in particular, to a penta-band internal antenna and a mobile communication terminal.

BACKGROUND

Along with the miniaturization development trend for mobile communication transmit-receive terminals, especially the miniaturization of mobile phones, there may be a need for smaller and smaller antennas. In the field of mobile phones, a drawback of an initial external antenna, which is a very short device extruding from a housing, may be that such external antenna may have a sensitive mechanical structure and may be easy to break off. So from the aspect of design, an antenna may be hidden or integrated within the housing of a communication device. Such internal antenna or integrated antenna may need to be able to cover the total bandwidth of various radio channels.

At present, multi-system communication standards may require an integrated antenna to cover a frequency range from 824 MHz to 2170 MHz. For this a certain problem may exist particularly in a handheld mobile communication terminal such that a resonance deviation of various degrees may be caused during a conversation to the antenna because the handheld mobile communication terminal may go through different positions when it is held by a user. Such resonance frequency deviation may have to be compensated by bandwidth, such that the bandwidth of the antenna may have to be wider than the frequency band needed to compensate for the loss brought by resonance frequency deviation. But in the prior art, usually only with larger physical dimensions can the broadband antenna compensate for the loss brought by resonance frequency deviation. However, this may go against the development trend of miniaturizing mobile communication terminals.

Therefore, the prior art needs to be improved and developed.

SUMMARY OF THE INVENTION

An embodiment of the present invention may provide a penta-band internal antenna and a mobile communication terminal to achieve relatively large bandwidth characteristics within a finite space to meet a miniaturization development demand of mobile communication terminals.

In an exemplary embodiment, a penta-band internal antenna may include a first high-frequency branch, a second high-frequency branch a low-frequency branch of an antenna radiating element, a first slotted hole and a second slotted hole arranged on a printed circuit board. The first slotted hole may be arranged along a direction substantially perpendicular to current flow direction of the printed circuit board. An open-circuit end of the low-frequency branch may be fitted into the first slotted hole. An open-circuit end of the second high-frequency branch may be fitted into the second slotted hole.

In an exemplary embodiment, the penta-band internal antenna may include the printed circuit board in a substantially rectangular shape, a line connecting a ground pin and a feed pin of the antenna radiating element may be set along a long side of the substantially rectangular shape. The first slotted hole may be arranged along a short side of the substantially rectangular shape.

In an exemplary embodiment, the penta-band internal antenna may include the second slotted hole arranged along a short side of the substantially rectangular shape.

In an exemplary embodiment, the penta-band internal antenna may include an open end of the first slotted hole set on the long side of the substantially rectangular shape which is not attached to the ground pin and the feed pin of antenna radiating element.

In an exemplary embodiment, the penta-band internal antenna may include an open end of the second slotted hole and the open end of the first slotted hole set on the same long side of the substantially rectangular shape.

In an exemplary embodiment, the penta-band internal antenna may include the length of the first slotted hole as less than that of the short side of the substantially rectangular shape.

In an exemplary embodiment, the penta-band internal antenna may include a length of the second slotted hole as less than that of the first slotted hole.

In an exemplary embodiment, the penta-band internal antenna may include the first high-frequency branch and the second high-frequency branch as respectively located on opposite sides of the ground pin and the feed pin. Both the first high-frequency branch and the low-frequency branch may be located on the same side of the ground pin and the feed pin.

In an exemplary embodiment, an extending direction of the open-circuit end of the first high-frequency branch and the extending direction of the open-circuit end of the second high-frequency branch may be substantially perpendicular to each other.

In an exemplary embodiment, a mobile communication terminal may include a housing and a printed circuit board and an internal antenna arranged in the housing. The internal antenna may include a first high-frequency branch, a second high-frequency branch, a low-frequency branch of an antenna radiating element, a first slotted hole and a second slotted hole arranged on the printed circuit board. The first slotted hole may be arranged along a direction substantially perpendicular to current flow direction of the printed circuit board. The open-circuit end of the low-frequency branch may be fitted into the first slotted hole. The open-circuit end of the second high-frequency branch may be fitted into the second slotted hole.

In an exemplary embodiment, the penta-band internal antenna and the mobile communication terminal may include slotted holes (including the first slotted hole and the second slotted hole) on the printed circuit board to adjust its low-frequency resonance model to be close to the center frequency of the antenna low-frequency branch. The printed circuit board may be excited to resonate through the capacitance coupling of a low-frequency branch of the antenna, and expand the bandwidth of the antenna in a low-frequency band. At the same time, by the capacitance coupling of the second high-frequency branch the second slotted hole may be excited to resonate. The second slotted hole may be connected in parallel with the self-resonance of the first high-frequency branch and the self-resonance of the second high-frequency branch to form a new high-frequency bandwidth. Therefore the bandwidth of the antenna in a high-frequency band may be expanded. The expanded low-frequency bandwidth and the expanded high-frequency bandwidth may compensate for the frequency deviation caused by the terminal being held in a user's hand and optimize the characteristics of the mobile communication terminal when it is in a handheld model. As a result, relatively large bandwidth characteristics may be achieved in a finite space and accordingly the development demand for miniaturizing the mobile communication terminals may be satisfied.

DETAILED DESCRIPTION OF THE INVENTION

The specific implementation methods and embodiments of the present invention may be further described in detail below with reference to the accompanying drawings. It should be understood that the embodiments described herein are only used for describing the present invention with no intention to limit the specific implementation methods of the present invention in any way.

Figure 1:
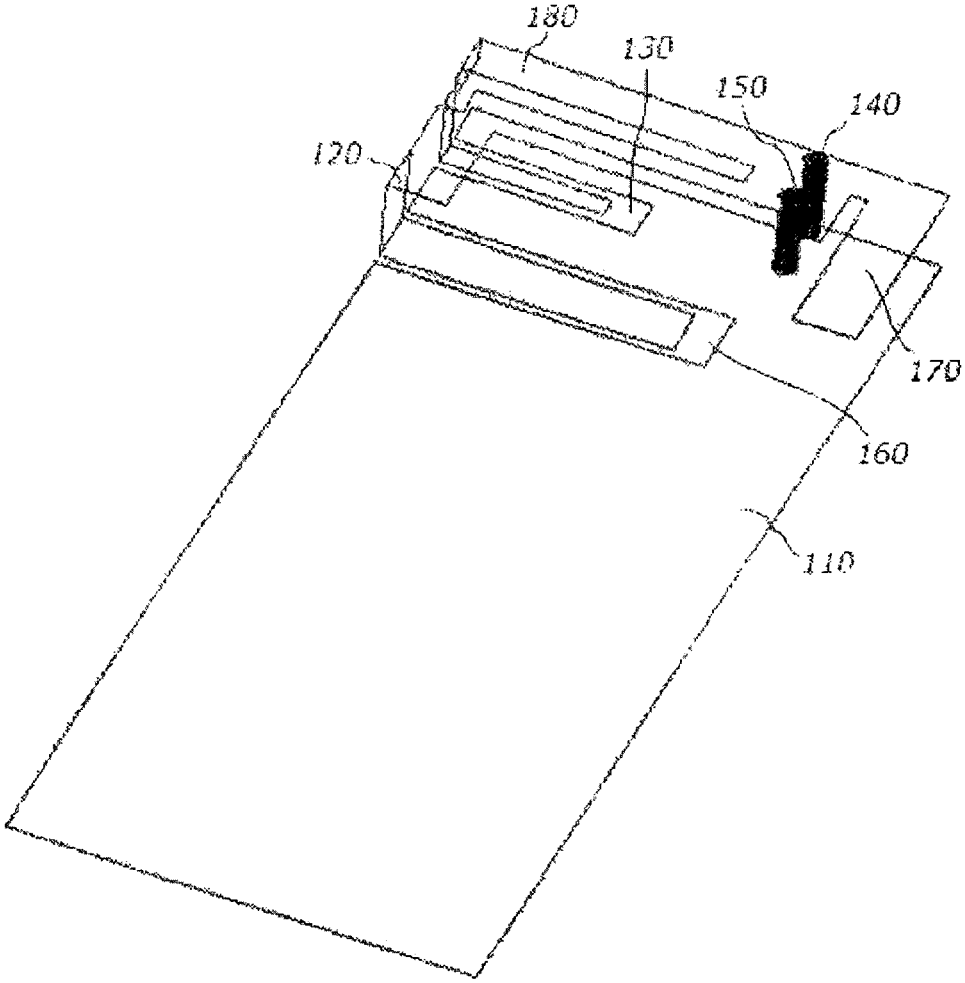
FIG. 1 is a spatial structure schematic diagram of a penta-band internal antenna according to an exemplary embodiment of the present invention.

In an exemplary embodiment a penta-band internal antenna may include one of the embodiments as shown in FIG. 1, including a first high-frequency branch 170, a second high-frequency branch 180, a low-frequency branch 120 of an antenna radiating element, a first slotted hole 160 and a second slotted hole 130 arranged on a printed circuit board 110. The first high-frequency branch 170, the second high-frequency branch 180 and the low-frequency branch 120 may be connected in parallel. The first slotted hole 160 may be arranged along a direction substantially perpendicular to the current flow direction of the printed circuit board 110. The open-circuit end of the low-frequency branch 120 may be fitted into the first slotted hole 160. The open-circuit end of the second high-frequency branch 180 may be fitted into the second slotted hole 130.

In an exemplary embodiment, a mobile communication terminal may include a housing, and a printed circuit board 110 and an internal antenna arranged in the housing. The internal antenna may include a first high-frequency branch 170, a second high-frequency branch 180 and a low-frequency branch 120 of an antenna radiating element and a first slotted hole 160, and a second slotted hole 130 may be arranged on a printed circuit board 110. The first high-frequency branch 170, the second high-frequency branch 180 and low-frequency branch 120 may be connected in parallel. The first slotted hole 160 may be arranged along a direction substantially perpendicular to the current flow direction of the printed circuit board 110. The open-circuit end of the low-frequency branch 120 may be fitted into the first slotted hole 160. The open-circuit end of the second high-frequency branch 180 may be fitted into the second slotted hole 130.

Compared with the broadband antennas and mobile communication terminals of the prior art, the penta-band internal antenna and the mobile communication terminal, having slotted holes (including the first slotted hole 160 and the second slotted hole 130) on the printed circuit board 110 to adjust its low-frequency resonance model to be close to the center frequency of antenna low-frequency branch 120, and exciting printed circuit board 110 to resonate through the capacitance coupling of low-frequency branch 120 of the antenna, expands the bandwidth of the antenna in a low-frequency band. At the same time, by the capacitance coupling of the second high-frequency branch 180, the second slotted hole 130 may be excited to resonate, and connects in parallel with the self-resonance of the first high-frequency branch 170 and the self-resonance of the second high-frequency branch 180 to form a new high-frequency bandwidth. The bandwidth of the antenna in a high-frequency band may be expanded. The expanded low-frequency bandwidth and the expanded high-frequency bandwidth may compensate for the frequency deviation caused by the terminal being held in a user's hand and may optimize the characteristics of the mobile communication terminal when it is in a handheld model. As a result, relatively large bandwidth characteristics may be achieved in a finite space and accordingly the development demand for miniaturizing the mobile communication terminals may be satisfied.

In an exemplary embodiment, a penta-band internal antenna and a mobile communication terminal with a planar inverted F antenna is shown in FIG. 1. The planar inverted-F antenna may include a first high-frequency branch 170 of the antenna radiating element, a second high-frequency branch 180 of the antenna radiating element and a low-frequency branch 120 of the antenna radiating element. The working principle of the terminal open-circuits of the first high-frequency branch 170 and the second high-frequency branch 180 may include about a quarter-wavelength resonance. Because the size of the antenna radiating element may be limited by the volume of the mobile communication terminal, the self-resonant bandwidth may be unable to meet the requirements of radio channels for multiple communication systems. In a low-frequency band the antenna radiating element may be unable to cover GSM5850 and GSM900 simultaneously. GSM herein means global system for mobile communication. Therefore, the antenna radiating element can be used as an exciting element to excite the printed circuit board 110 and together with the advantage of a larger printed circuit board 110, the antenna radiating element may be a resonance model of a low-frequency band.

Figure 2:
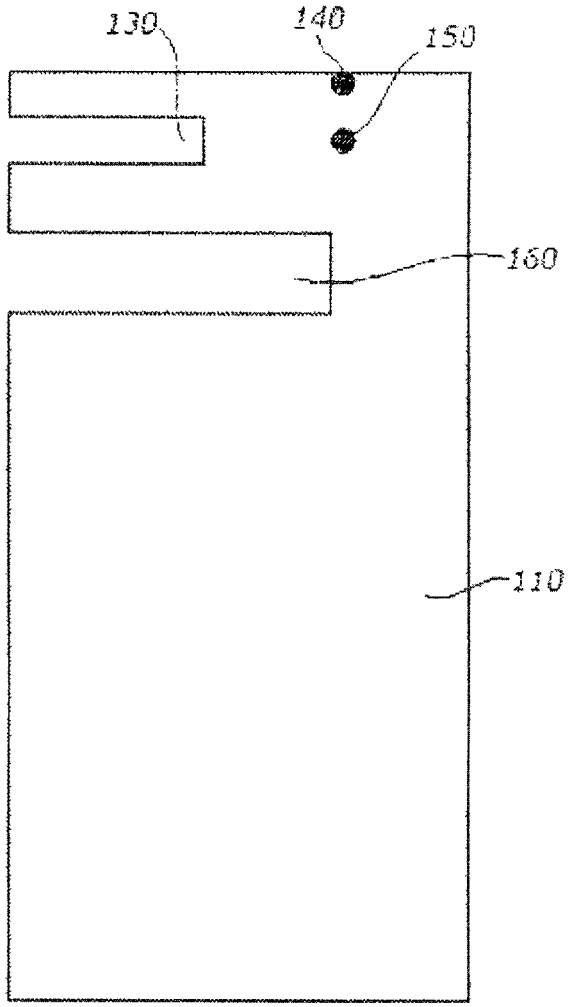
FIG. 2 is a plane structure schematic diagram of a penta-band internal antenna according to an exemplary embodiment of the present invention on PCB section.

In an exemplary embodiment, as shown in FIG. 2, the shape of printed circuit board 110 may be substantially a rectangle. The line connecting ground pin 140 and feed pin 150 of the antenna radiating element may be set along a long side of the substantially rectangular shape. The first slotted hole 160 may be set along a short side of the substantially rectangular shape.

In an exemplary embodiment, the longitudinal current of the printed circuit board 110, which may be along the length direction of the substantially rectangular shape, and may have increased radiation efficiency, while the radiation performance in a low-frequency band may be mainly determined by the longitudinal current of the printed circuit board 110. Therefore, changing the resonance frequency of the longitudinal current of the printed circuit board 110 to make it closer to the center frequency of low-frequency band, can in one aspect increase radiation efficiency, and in another aspect can also expand the bandwidth of a low-frequency band.

In an exemplary embodiment, the first slotted hole 160 can be added along a direction that is substantially perpendicular to the longitudinal current to change the flowing direction of the current and compel the current to pass through the first slotted hole 160, which may be equivalent to extending the longitudinal current length. For example, the first slotted hole 160 may be arranged substantially parallel to the width direction of the printed circuit board 110 without completely cutting the printed circuit board 110 off. By this time, the open-circuit end of the low-frequency branch 120 may go deep into the first slotted hole 160 and may excite the longitudinal current of the printed circuit board 110 through capacitance coupling. Excited by the low-frequency branch 120 of the antenna radiating element, the first slotted hole 160 may make the printed circuit board 110 resonate. The resonance of the printed circuit board may combine with the self-resonance of the low-frequency branch 120, and this combination may be equivalent to a parallel connection of two resonance circuits in terms of circuits. The bandwidth may cover the frequency bands of GSM850 and GSM900.

In an exemplary embodiment, as shown in FIG. 2, the open end of the first slotted hole 160 may be set on the long side of the substantially rectangular shape which may be away from the ground pin 140 and feed pin 150 of the antenna radiating element. The length of the first slotted hole 160 may be set to be not longer than the length of the short side of the substantially rectangular shape.

In an exemplary embodiment, the length of the first slotted hole 160 can be designed close to about a quarter-wavelength of the high-frequency band. With a short-circuit and an open-circuit, the about a quarter-wavelength resonance frequency may be within an operating frequency band of a high-frequency band. The resonance generated thereby can help expand the bandwidth of the high-frequency band so that the bandwidth can cover frequency bands of DCS1800 (Digital Cellular System at 1800 MHz) and PCS (Personal Communications System operating in the 1900 MHz band).

In an exemplary embodiment, the second high-frequency branch 180 of the antenna radiating element may go deeply into the second slotted hole 130, and may excite the second slotted hole 130 to resonate through capacitance coupling, which together with the self-resonance of the first high-frequency branch 170 of the antenna radiating element and the self-resonance of the second high-frequency branch 180 of the antenna radiating element may form a parallel connection. The bandwidth can cover the ranges required by a high-frequency band, that is DCS, PCS and UMTS band 1,2,5,8. UMTS herein means universal mobile telecommunications system.

Figure 3:
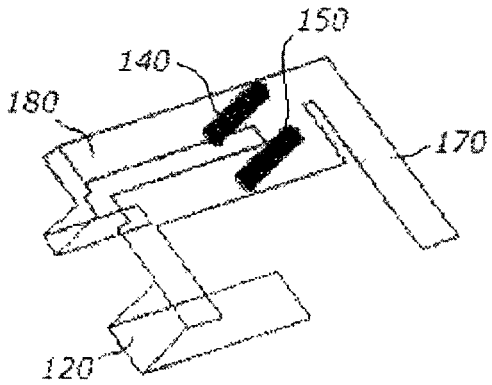
FIG. 3 is a spatial structure schematic diagram of an antenna radiating element of a penta-band internal antenna according to an exemplary embodiment of the present invention.

In an exemplary embodiment, as shown in FIG. 3, the first high-frequency branch 170 and the second high-frequency branch 180 may be respectively located on opposite sides of the ground pin 140 and feed pin 150. Both the first high-frequency branch 170 and low-frequency branch 120 may be located on the same side of the ground pin 140 and feed pin 150. The extending direction of the open-circuit end of the first high-frequency branch 170 and the extending direction of the open-circuit end of the second high-frequency branch 180 may be substantially perpendicular to each other.

In an exemplary embodiment, as shown in FIG. 2, the second slotted hole 130 can also be set along a short side of the substantially rectangular shape. The open end of the second slotted hole 130 and the open end of the first slotted hole 160 can be set on the same long side of the substantially rectangular shape. The length of the second slotted hole 130 may be less than that of the first slotted hole 160.

Thus it can be seen that the penta-band internal antenna of the present invention can improve the antenna's bandwidth by the following means: on one hand by adding the first slotted hole 160 to change the resonance model of the printed circuit board 110 to expand the bandwidth of the antenna in a low-frequency band. On the other hand the antenna's bandwidth may be increased by exciting the second slotted hole 130 to self-resonate to improve the bandwidth of the antenna in a high-frequency band.

In an exemplary embodiment, the bandwidth performance of the antenna in a low-frequency band may basically be determined by the size of the printed circuit board 110, including the length. The bandwidth that is covered by the self-resonance of the internal antenna may be far from meeting the requirements of channels for communication systems because of its small size. However, the resonating printed circuit board 110 may be at a frequency which is much closer to the center frequency of the antenna in a low-frequency band and the bandwidth generated thereby may be wider than that of a self-resonating internal antenna.

Therefore, effectively exciting a printed circuit board 110 to resonate may be an effective way to expand the bandwidth of the antenna in a low-frequency band. Arranging the first slotted hole 160 along the direction substantially perpendicular to a current flow direction of the printed circuit board 110 to extend the current path can reduce the resonance frequency of the printed circuit board 110 and make it closer to the center frequency of the low-frequency. As a result the bandwidth range of the internal antenna in a low-frequency band is improved.

In addition, the second slotted hole 130 on the printed circuit board 110 can be equivalent to about a quarter-wavelength slot antenna in a high-frequency band. The resonance generated by the slot antenna which may be serving as a spurious unit of the internal antenna, and can improve the bandwidth of the antenna in a high-frequency band.

In conclusion, by adding the first slotted hole 160 and the second slotted hole 130 on the printed circuit board 110, using the second high-frequency branch 180 of the antenna radiating element and the low-frequency branch 120 of the antenna radiating element to excite the printed circuit board 110 to resonate effectively, and achieving the high-frequency spurious unit functions of the first slotted hole 160 and the second slotted hole 130, the bandwidth of the internal antenna in a low-frequency band and in a high-frequency band may be improved by the antenna of the communication device within a limited space. The bandwidth of the antenna in a low-frequency band and in a high-frequency band may be improved by the use of the slotted holes on the printed circuit board 110 to be able to cover the frequency bands of GSM850, EGSM900, DCS, PCS and UMTS band 1, 2, 5, 8. The expended bandwidth can compensate for the frequency deviation caused by the terminal in a hand held state, and accordingly optimize the performance of the mobile communication terminal in a hand held model, and the miniaturization and broad band of a portable wireless communication devices may be achieved.

Figure 4:
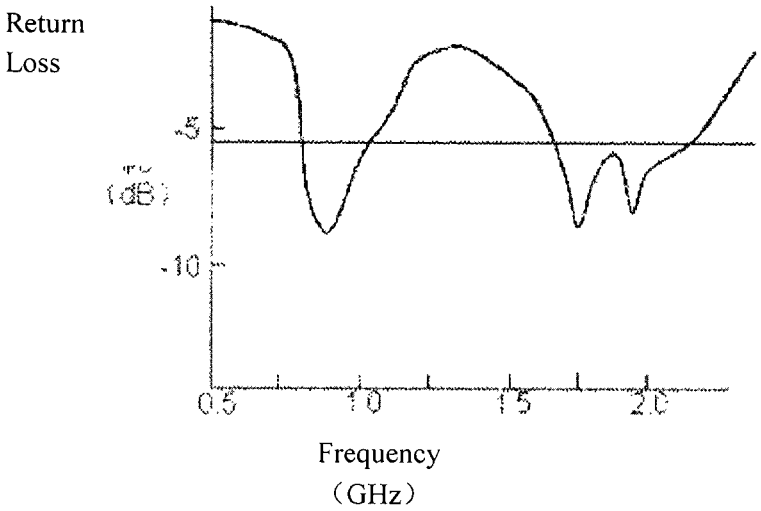
FIG. 4 is a curve graph of return loss test of a penta-band internal antenna according to an exemplary embodiment of the present invention.

Also the results of the test indicate that, as shown in FIG. 4, seen from the curve of return loss test, the penta-band internal antenna of the present invention indeed has enough bandwidth to satisfy the demands for frequency bands of GSM850, EGSM900, DCS, PCS and UMTS band 1, 2, 5, 8.

It should be understood that the description above is only the preferred embodiments of the present invention with no intention to limit the technical solutions of the present invention, for those skilled in this field, additions and reductions, replacements, variations and improvements can be made according to the above mentioned description without departing from the spirit and scope of the invention. For example, antenna radiating element includes, but is not limited to, a planar inverted-F antenna, while all these technical solutions with any addition or reduction, replacement, variation or improvement shall be encompassed in the scope defined by claims attached to the present invention.

The invented claimed is:

1. A penta-band internal antenna comprising:

a first high-frequency branch of an antenna radiating element;

a second high-frequency branch of the antenna radiating element;

a low-frequency branch of the antenna radiating element, wherein the first high-frequency branch, the second high-frequency branch and the low-frequency branch are connected in parallel;

a first slotted hole and a second slotted hole in a printed circuit board having a long side and a short side, wherein the first slotted hole is arranged along a direction substantially perpendicular to current flow direction within the printed circuit board, wherein an open-circuit end of the low-frequency branch is fitted into and defined by the first slotted hole, and an open-circuit end of the second high-frequency branch is fitted into and defined by the second slotted hole, wherein the first slotted hole and second slotted hole are set along the short side of the printed circuit board, wherein an open end of the first slotted hole and an open end of the second slotted hole are set on the same long side of the printed circuit board, and wherein the second high-frequency branch excites the second slotted hole to resonate through capacitance coupling which, together with a self-resonance of the first high-frequency branch and a self-resonance of the second high-frequency branch, forms a parallel connection between the second high-frequency branch, the second high-frequency branch and the low-frequency branch.

2. The penta-band internal antenna of claim 1, wherein: the shape of the printed circuit board is substantially rectangular, wherein a line connecting a ground pin and a feed pin of the antenna radiating element is set along the long side of the rectangle, and wherein the first slotted hole is set along the short side of the substantially rectangular shape.

3. The penta-band internal antenna of claim 2, wherein: the second slotted hole is set along the short side of the substantially rectangular shape.

4. The penta-band internal antenna of claim 2, wherein: the open end of the first slotted hole is set on the long side of the substantially rectangular shape which is away from the ground pin and the feed pin of the antenna radiating element.

5. The penta-band internal antenna according to claim 4, wherein: the open end of the second slotted hole and the open end of the first slotted hole are set on the same long side of the substantially rectangular shape.

6. The penta-band internal antenna according to claim 1, wherein: the length of the first slotted hole is less than that of the short side of the substantially rectangular shape.

7. The penta-band internal antenna according to claim 1, wherein: the length of the second slotted hole is less than that of the first slotted hole.

8. The penta-band internal antenna according to claim 2, wherein: the first high-frequency branch and the second high-frequency branch are respectively located on opposite sides of the ground pin and the feed pin, and wherein both the first high-frequency branch and the low-frequency branch are located on the same side of the ground pin and the feed pin.

9. The penta-band internal antenna according to claim 1, wherein: an extending direction of the open-circuit end of the first high-frequency branch and an extending direction of the open-circuit end of the second high-frequency branch are substantially perpendicular to each other.

10. A mobile communication terminal, comprising:

a housing and a printed circuit board and an internal antenna arranged in the housing, wherein the internal antenna comprises a first high-frequency branch, a second high-frequency branch, a low-frequency branch of an antenna radiating element, a ground pin, and a feed pin connected between the first high-frequency branch and the low-frequency branch, wherein the first high-frequency branch and the second high-frequency branch are respectively located on opposite sides of the ground pin and the feed pin, wherein a first slotted hole and a second slotted hole are formed in the printed circuit board, wherein an open end of the first slotted hole and an open end of the second slotted hole are set on a same side of the printed circuit board, wherein the first slotted hole is substantially perpendicular to a current flow direction within the printed circuit board, wherein an open-circuit end of the low-frequency branch is defined by the first slotted hole, wherein an open-circuit end of the second high-frequency branch is defined by the second slotted hole, and wherein the first slotted hole is arranged perpendicular to the current flow direction within the printed circuit board to reduce a resonance frequency of the printed circuit board and to make a resonance frequency of the printed circuit board closer to a center frequency of a low-frequency.

11. The mobile communication terminal of claim 10, wherein the first slotted hole self-resonates at about a quarter-wavelength of an input frequency.

12. The mobile communication terminal of claim 10, wherein the first slotted hole is substantially parallel with a width direction of the printed circuit board.

13. The mobile communication terminal of claim 10, wherein the ground pin and the feed pin of the antenna radiating element is set on a long side of the printed circuit board.

14. The mobile communication terminal of claim 10, wherein the open end of the second slotted hole and the open end of the first slotted hole are set on the same long side of the printed circuit board.

15. The mobile communication terminal of claim 10, wherein the length of the first slotted hole is less than that of a short side of the printed circuit board.

16. The mobile communication terminal of claim 10, wherein the length of the second slotted hole is less than that of the first slotted hole.

17. The mobile communication terminal of claim 13, and wherein both the first high-frequency branch and the low-frequency branch are located on the same side of the ground pin and the feed pin.

18. The mobile communication terminal of claim 10, wherein: an extending direction of the open-circuit end of the first high-frequency branch and an extending direction of the open-circuit end of the second high-frequency branch are substantially perpendicular to each other.

19. The penta-band internal antenna of claim 1, wherein the first slotted hole self-resonates at about a quarter-wavelength of an input frequency.

20. The penta-band internal antenna of claim 1, wherein the first slotted hole is substantially parallel with a width direction of the printed circuit board.

* * * * *